United States Patent [19]

Mano

[11] Patent Number: 4,846,387

[45] Date of Patent: Jul. 11, 1989

[54] PAPER GUIDE ASSEMBLY FOR PHOTOGRAPHIC PROCESSOR

[75] Inventor: Kozo Mano, Wakayama, Japan

[73] Assignee: Noritsu Kenkyu Center Co., Ltd., Wakayama, Japan

[21] Appl. No.: 55,388

[22] Filed: May 29, 1987

[30] Foreign Application Priority Data

May 31, 1986 [JP] Japan ..... 61-126527

[51] Int. Cl.[4] ..... B65H 23/04

[52] U.S. Cl. ..... 226/199; 74/527

[58] Field of Search ..... 226/196, 199; 74/527

[56] References Cited

U.S. PATENT DOCUMENTS

| | | | |
|---|---|---|---|
| 1,861,937 | 6/1932 | Philips | 74/527 |
| 2,522,779 | 9/1950 | Culkosky | 74/527 X |
| 3,119,534 | 1/1964 | Lehnert | 226/199 X |
| 3,119,539 | 1/1964 | Dodsworth | 226/199 |
| 3,896,983 | 7/1975 | Weiguni | 226/198 |

*Primary Examiner*—Daniel P. Stodola

*Attorney, Agent, or Firm*—Armstrong, Nikaido, Marmelstein, Kubovcik & Murray

[57] ABSTRACT

A paper guide assembly for use with a photographic processor is proposed, in which a pair of guide holders, each having a paper guide formed with a groove for supporting a printing paper, are arranged over and across a positioning bar and adapted to be slidably movable keeping parallel with each other. A vertically extending lever fixed to each guide holder is adapted to be removably inserted into one of recessed portions formed in the upper surface of the positioning bar. The adjustment of the distance between the guide holders are carried out by moving the pair of levers so that an indication on a rating plate provided on top of each lever will coincide with an indication on a rating plate provided on a frame cover which shows the width of paper. After selecting the desired position, when the levers are released, they will fit into the recesses, thus setting the guide holders in a desired position.

4 Claims, 2 Drawing Sheets

PAPER GUIDE ASSEMBLY FOR PHOTOGRAPHIC PROCESSOR

The present invention relates to a paper guide assembly for a photographic processor. It more particularly relates to a paper guide assembly for feeding printing paper in a stable manner without snaking or flapping in the process of feeding a rolled printing paper to a light exposure section or in the process of feeding the paper web which has been printed, developed and dried to a cutter section.

Rolls of printing paper having different paper widths are commercially available. Therefore, the distance between paper guides mounted on a paper feed device has to be changed every time the size of roll paper is changed so as to fit the paper to the paper guides. It is troublesome to replace, mount and fix the paper guides. To solve this problem, various paper guide assemblies which allow the change of the distance between a pair of paper guides have been proposed. In one of such assemblies, the adjustment of distance between a pair of paper guides is carried out by turning a threaded shaft threadedly engaging the guide frames.

Although the conventional fixed paper guides are simple in mechanism, they have to be dismounted and replaced with other ones every time the width of paper is changed. With the paper guide so adapted that the distance is adjustable by use of the threaded shaft, the adjustment of distance between the paper guides is easily done. But they have to be readjusted when assembled, and the thread has to be formed accurately and necessarily has some backlash. Further, it has to be provided with a threaded shaft and a stop system for keeping the paper guides coupled to the threaded shaft through gears in a predetermined position, and with a sensor system for sensing the position. Thus, the mechanism tends to be complicated and costly and needs much care for maintenance.

An object of the present invention is to provide a paper guide assembly which obviates the abovesaid problems.

In accordance with the present invention, there is provided a paper guide assembly for a photographic processor comprising a positioning bar formed with a plurality of pairs of recesses, each pair of the recesses being arranged so as to correspond to each of different paper widths, a pair of guide holders mounted over and across the positioning bar so as to be slidable along the positioning bar, keeping parallel with each other, each guide holder being provided with an elongate paper guide formed with an inwardly opening groove for supporting paper, and a lever having one end mounted on each of the guide holders in its upright position and adapted to be removably inserted into one of the recesses formed in the positioning bar.

According to the present invention, a pair of levers mounted on the guide holders are adapted to be lidable along the slots in the positioning bar in order to adjust the indication on the knob mounted on top of each lever to a desired indication on the rating plate on the frame cover. Thus, each paper guide fixed to the guide holder can be set in a desired position easily and accurately, eliminating the possibility of its deflection.

The pins protruding from the levers are resiliently inserted into predetermined recesses by action of locking compression springs. Thus, the paper guides are securely set in position without even the slightest unexpected displacement. Further, each groove is formed with a plurality of holes and pairs of cutouts, which make it possible to cope with a change in paper size. Also, the paper guides can be controlled visually in a foolproof manner, using two rating plates for each paper guide, and their position can also be visually checked. Block-shaped elongate boss members are used for the guide holder where the guide holders and the slide shaft on one side are in sliding contact, so that the deflection of the guide holders are restricted to a minimum, thus assuring a stable positioning of the paper guides.

The elongate block-shaped boss members prevent the guide holders from deflecting, thus eliminating the necessity of machining the slide shaft accurately and simplifying the production process. Further, if the positioning bar is used as a guide member to guide the pair of guide holders along the positioning bar, keeping parallel with each other, the mechanism of the assembly will be simpler, making it possible to cut down the production cost.

Other features and objects of the present invention will become apparent from the following description taken with reference to the accompanying drawings, in which.

Figure 6:
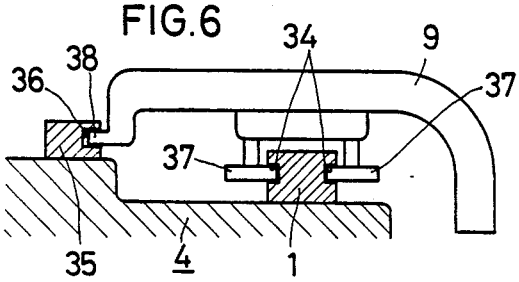
FIG. 6 is a transverse sectional view of the positioning bar and the guide holder put together in another embodiment.
Figure 8:
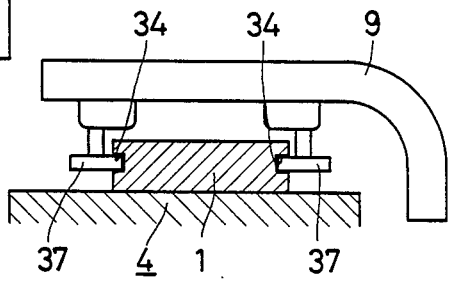
Figure 7:
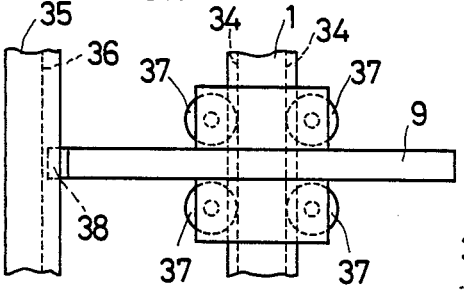
FIG. 7 is a plan view of the same.
Figure 9:
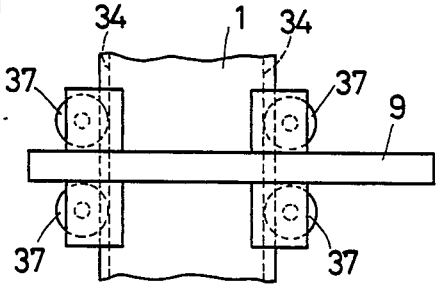

FIGS. 8 and 9, each corresponding to FIGS. 6 and 7, respectively, showing a further embodiment.

Figure 1:
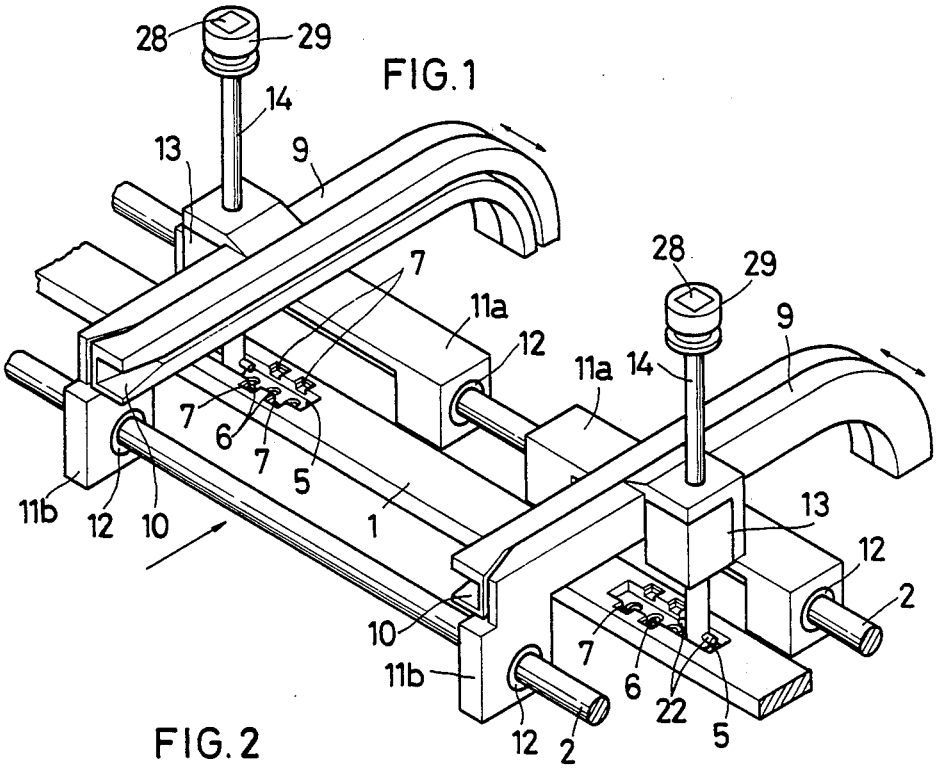
FIG. 1 is a perspective view of a portion of the paper guide assembly in accordance with the present invention.

Now referring to the drawings, FIG. 1 is a perspective view of a portion of the assembly according to the present invention, which comprises a positioning bar 1 and slide shafts 2 disposed at both sides of the positioning bar 1 and extending in parallel therewith. The bar 1 and the shafts 2 are arranged above a base 4 and have their both ends rigidly supported on side frames 3.

Figure 2:
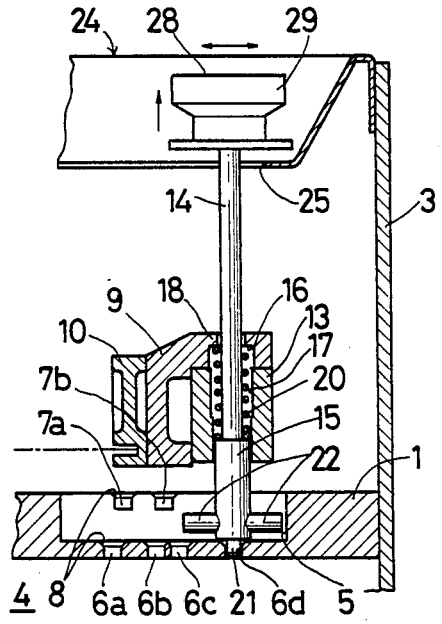
FIG. 2 is a vertical sectional view of the righthand side of the paper guide assembly in which holes formed in the bottom of the groove are used.
Figure 3:
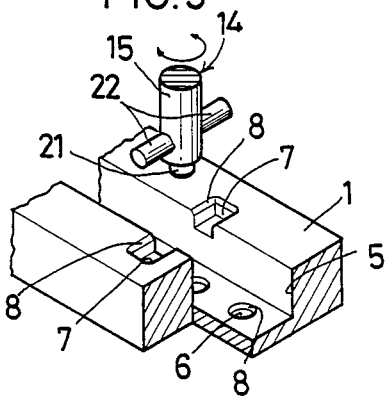
FIG. 3 is a perspective view showing the relationship between the positioning bar and the lever, in which a pair of cutouts formed in the side walls of the groove are used.
Figure 4:
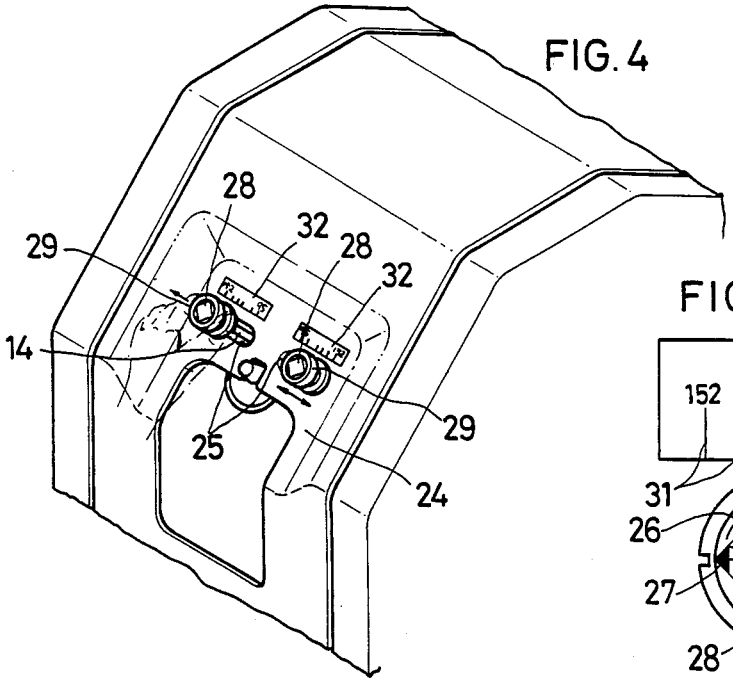
FIG. 4 is a perspective view showing how knobs are provided on the lever so as to project from the frame cover.

The positioning bar 1 is formed in its upper surface with a pair of elongate grooves 5 spaced apart from each other by a predetermined distance and extending in the longitudinal direction. Each of the elongate grooves 5 is in turn formed with holes 6 in its bottom surface which are positioned according to the width of paper. Namely, a plurality of such holes 6 serve as stop points for a pair of paper guides which will be described later. More specifically, each of the elongate grooves 5 is formed with a hole **6*a* for 95 mm wide paper, a hole 6*b* for 117 mm wide paper, a hole 6*c*** for 127 mm wide paper and a hole 6*d* for 152 mm wide paper from its inside to outwardly (FIGS. 1 and 2).

Each elongate groove 5 is also formed with pairs of cutouts 7 in both side walls thereof so that each pair of cutouts will be opposed to each other. More specifically, a pair of cutouts 7*a* for 102 mm wide paper are formed between the holes 6*a* and 6*b*. A pair of cutouts 7*b* for 120 mm wide paper are formed between the holes 6*b* and 6*c* (FIGS. 1 and 2). Each of the pairs of holes 6*a*–6*d* formed in both grooves 5 and the pairs of cutouts 7*a*–7*b* formed in the opposite side walls of each groove 5 correspond to each paper size. The edges 8 of the holes 6 and cutouts 7 are formed into countersink shape so as to facilitate the insertion of a pin into them. A pair of guide holders 9 are provided so as to extend over and across the positioning bar 1 and the slide shafts 2. Each guide holder 9 is provided on its surface with an elongate paper guide 10 having its inner side open. The guide holder 9 is formed at both ends with boss portions 11*a* and 11*b* to support the slide shafts 2. An oil-containing metal 12 is interposed at the frictional surface between each boss and shaft. The bosses 11*a* are in the form of elongate block so as to provide a longer frictional surface for the slide shaft 2. With this arrangement, the guide holders 9 are effectively restrained from swinging and rattling relative to the slide shafts 2.

Each guide holder 9 is provided with a lever holder 13. A lever 14 extends vertically through a hole 17 in each lever holder 13, the hole 17 communicating with a hole 16 of each guide holder 9. A locking compression spring 20 is interposed between a flange 18 defining the hole 16 in the guide holder 9 and an upper end wall of an enlarged portion 15 of the lever 14 so as to normally urge the lever 14 downwardly. The lever 14 is provided on the lower end of its enlarged portion 15 with a pin 21 and on its both sides with a pair of horizontal pins 22. The pin 21 and the horizontal pins 22 are adapted to be engaged in one of the holes 6 and in a pair of cutouts 7 oppositely formed in the opposite side walls of the groove 5, respectively, under the compressive force of the locking compression spring 20.

Each lever 14 extending through a slit 25 formed in a frame cover 24 is engaged in one of the holes 6, keeping its upright position. On the top of the lever 14 is provided a knob 29 on which a rating plate 28 is stuck to show the turning direction 26 of the lever and the indication 27 for paper size selection. Stuck on the upper surface of the frame cover 24 above the slit 25 is another rating plate 32 marked with the indication 31 of the paper width, i.e. the location of the holes 6 and cutouts 7 so arranged that each pair will correspond to each paper size.

The knob 29 of each lever 14 is held by hand and turned so that its horizontal pins 22 will be in parallel with each groove 5. The lever 14 is pulled up against the compression spring 20 and moved sideways so that the indication 27 of the rating plate 28 on the knob 29 for selection of the paper width will coincide with the desired indication 31 of the rating plate 32 provided on the frame cover 24 to distinguish the paper size. By releasing the knob 29, the pin 21 formed on the bottom end of each lever 14 will be inserted into a selected hole 6, urged by the compression spring 20.

Figure 5:
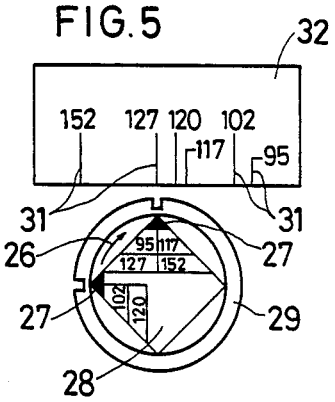
FIG. 5 is a plan view showing the relationship between the rating plate on the knob showing the turning direction of the lever and marked with an indication for the selection of paper width and the rating plate on the upper surface of the frame cover marked with an indication showing the width of paper.

If it is desired to use the cutouts 7, in other words, to set the paper guides so that paper 102 mm or 120 mm wide will fit into it, the lever 14 is pulled up against the compression spring 20 so as to get the pin 21 on the lower end of the lever out of the hole 6. The lever is then turned by 90 degrees clockwise in FIG. 5, and moved sideways so that the indication 27 of the knob 29 for selection of the paper size will coincide with the desired indication 31 of the rating plate 32. By releasing the knob 29, the pair of horizontal pins 22 are inserted into a pair of cutouts 7 for a desired paper size, setting the lever 14 and thus the paper guide 10 in position. The width between the pair of paper guides 10 which coincides with a selected size of paper for printing is set by the positioning of the righthand and lefthand levers 14.

In the abovesaid embodiment, when both guide holders 9 are displaced in parallel with each other along the positioning bar 1, they are guided on the slide shafts 2. In another embodiment shown in FIGS. 6 through 9, the positioning bar 1 itself serves to guide the guide holders 9.

FIGS. 6 and 7 are schematic transverse sectional views showing the positioning bar 1 and the guide holders 9 put together. The metallic positioning bar 1 mounted on the base 4 is formed in its both side surfaces with a pair of recessed rails 34 extending longitudinally with respect to the bar 1. Also provided on the base 4 is a guide bar 35 of synthetic resin extending in parallel with the positioning bar 1. The guide bar 35 is also formed with a recessed rail 36 in one side wall thereof. Each guide holder 9 provided with a paper guide (not shown) has two pairs of rollers 37 on its bottom. The rollers 37 are rollingly engaged in the pair of recessed rails 34. A projection 38 formed on one end of the guide holder 9 is engaged in the recessed rail 36 of the guide bar 35. Thus, the pair of guide holders 9 can move toward and away from each other, keeping parallel with each other and crossing over and along the positioning bar 1.

FIGS. 8 and 9 show another embodiment, each corresponding to FIGS. 6 and 7, respectively. In this embodiment, the positioning bar 1 provided on the base 4 is wider than the one in the embodiment shown in FIGS. 6 and 7. The bar 1 is formed with the pair of longitudinally extending recessed rails 34 in its both side walls. The guide holder 9 supporting the paper guide (not shown) is provided on its bottom with the two pairs of rollers 37. These rollers 37 are rollingly inserted into the pair of recessed rails 34 so as to grip the positioning bar 1 from both sides. The positioning bar 1, as in the previous embodiment, has a pair of grooves 5 formed in its upper surface at both sides, each having cutouts 7 and holes 6. Also each guide holder 9 is provided with an upright lever 14.

What is claimed is:

1. A paper guide assembly for a photographic processor comprising a positioning bar formed with a plurality of pairs of recesses, each pair of said recesses corresponding to each of different paper widths, a pair of guide holders mounted over and across said positioning bar so as to be slidable along said positioning bar, keeping parallel with each other, said each guide holder being provided with an elongate paper guide formed with an inwardly opening groove for supporting paper, and a lever having one end mounted on each of said guide holders in its upright position for removably inserting into a pair of selected recesses of said plurality of pairs of recesses formed in said positioning bar at a selected paper width for positioning said paper guide with said inwardly opening groove at said selected paper width for supporting and guiding paper of said selected paper width when passed therethrough.

2. A paper guide assembly for a photographic processor as claimed in claim 1, wherein said levers are normally urged downwardly by means of compression springs.

3. A paper guide assembly for a photographic processor comprising a positioning bar formed with a plurality of pairs of recesses, each pair of said recesses being arranged so as to correspond to each of different paper widths, a pair of guide holders mounted over and across said positioning bas so as to be slidable along said positioning bar, keeping parallel with each other, said each guide holder being provided with an elongate paper guide formed with an inwardly opening groove for supporting paper, and a lever having one end mounted on each of said guide holders in its upright position and adapted to be removably inserted into one of said recesses formed in said positioning bar, said recesses comprising a plurality of holes formed in the bottom of elongate grooves formed in the upper surface of said positioning bar, and a plurality of pairs of cutouts in the opposite side walls of said each elongate groove in opposite relation to each other, each of said holes being adapted to receive a pin provided at the bottom of said each lever, each pair of said cutouts being adapted to receive a pair of horizontal pins provided on the lower end of said each lever so as to extend in opposite directions.

4. A paper guide assembly for photographic processor as claimed in claim 3, wherein said levers are normally urged downwardly by means of compression springs.

* * * * *